US009349526B2

(12) United States Patent
Takagi et al.

(10) Patent No.: US 9,349,526 B2
(45) Date of Patent: May 24, 2016

(54) PULSE TRANSFORMER

(71) Applicant: TDK CORPORATION, Tokyo (JP)

(72) Inventors: Nobuo Takagi, Tokyo (JP); Setu Tsuchida, Yamagata (JP); Tasuku Mikogami, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 14/224,581

(22) Filed: Mar. 25, 2014

(65) Prior Publication Data

US 2014/0292465 A1 Oct. 2, 2014

(30) Foreign Application Priority Data

Mar. 29, 2013 (JP) ..... 2013-072035

(51) Int. Cl.

| | |
|---|---|
| ***H01F 27/29*** | (2006.01) |
| ***H01F 27/02*** | (2006.01) |
| ***H01F 27/28*** | (2006.01) |
| ***H01F 17/04*** | (2006.01) |
| *H01F 3/10* | (2006.01) |

(52) U.S. Cl.

CPC ..... *H01F 27/292* (2013.01); *H01F 3/10* (2013.01); *H01F 27/2828* (2013.01)

(58) Field of Classification Search

CPC ..... H01F 27/292; H01F 5/04; H01F 30/06; H01F 27/2847; H01F 6/06

USPC ..... 336/83, 192, 220, 221, 222, 225

See application file for complete search history.

(56) References Cited

U.S. PATENT DOCUMENTS

| | | | | |
|---|---|---|---|---|
| 7,889,045 | B2 * | 2/2011 | Tomonari et al. | 336/200 |
| 2005/0052267 | A1 | 3/2005 | Singu et al. | |
| 2008/0309445 | A1 * | 12/2008 | Suzuki et al. | 336/183 |
| 2010/0109827 | A1 * | 5/2010 | Asou et al. | 336/192 |
| 2013/0049914 | A1 | 2/2013 | Huang et al. | |
| 2013/0229254 | A1 * | 9/2013 | Lee et al. | 336/220 |

FOREIGN PATENT DOCUMENTS

| | | | |
|---|---|---|---|
| JP | 2008034777 | A * | 2/2008 |
| JP | 2009-302321 | | 12/2009 |
| JP | 2010-010597 | | 1/2010 |
| JP | 2010010597 | A * | 1/2010 |
| JP | 2010-109267 | | 5/2010 |
| JP | 2011-253889 | | 12/2011 |
| JP | 2012-248610 | | 12/2012 |

OTHER PUBLICATIONS

U.S. Appl. No. 14/224,556, filed Mar. 25, 2014, by Takagi et al.

* cited by examiner

*Primary Examiner* — Tsz Chan

(74) *Attorney, Agent, or Firm* — Greenblum & Bernstein, P.L.C.

(57) ABSTRACT

A pulse transformer is provided with a drum core 2 including a winding core 3 and first and second flanges 4A and 4B, and wires S1 to S4 wound around a winding core 3 of the drum core 2. Terminal electrodes 6*a* and 6*b* and a center tap 6*c* are provided on the flange 4A, and terminal electrodes 6*d* and 6*e* and a center tap 6*f* are provided on the flange 4B. Each end of the wires S1 to S4 is connected to a corresponding one of the terminal electrodes P1 and N1, the center tap CT2, the terminal electrodes P2 and N2, and the center tap CT1. A front end of the terminal electrode 6*b* is setback toward an outer side surface of the flange 4A, and a front end of the terminal electrode 6*e* is setback toward an outer side surface of the first flange 4B.

22 Claims, 13 Drawing Sheets

PULSE TRANSFORMER

BACKGROUND OF THE INVENTION

1. Field of the Invention

The present invention relates to a pulse transformer and, more particularly, to a surface-mount pulse transformer using a drum-type core.

2. Description of Related Art

In recent years, in a circuit component such as a connecter, a pulse transformer is widely used for isolating a differential signal at an input side (primary side) and a differential signal at an output side (secondary side). In order to mount a plurality of pulse transformers on a printed circuit board at high density, it is preferable to use a surface-mount pulse transformer using a drum core (see Japanese Patent Application Laid-Open Nos. 2009-302321 and 2010-109267).

A pulse transformer described in the Japanese Patent Application Laid-Open No. 2010-109267 has a configuration in which primary-side terminal electrodes and a secondary-side center tap are formed in one flange of a drum core, and secondary-side terminal electrodes and a primary-side center tap are formed in the other flange. Wires constituting a pair of coils are wound around a winding core of the drum core, and each end portion of the wires is connected to a corresponding terminal electrode or center tap. Such a pulse transformer is required to have a configuration capable of accurately winding the wires using an automatic winding machine and reliably connecting each end of the wires to the corresponding one of the terminal electrodes.

FIG. 13 is an exemplary plan view illustrating a terminal electrode structure of a conventional pulse transformer.

A pulse transformer illustrated in FIG. 13 has a drum core. A pair of primary-side terminal electrodes 6*a* and 6*b* and a secondary-side center tap 6*c* are provided on one flange 4A of the drum core, and a pair of secondary-side terminal electrodes 6*d*, 6*e* and a primary-side center tap 6*f* are provided on the other flange 4B of the drum core. In the flange 4A, the primary-side terminal electrode 6*b* is distanced from the secondary-side center tap 6*c* so as to ensure withstand voltage between the primary and secondary sides. Similarly, in the flange 4B, the secondary-side terminal electrode 6*e* is distanced from the primary-side center tap 6*f*.

A pair of coils constituting the pulse transformer includes four wires S1, S2, S3, and S4. The wires S1 and S2 constitute a primary-side coil, and wires S3 and S4 constitute a secondary-side coil. In FIG. 13, only lead sections of the wires are illustrated, and winding portions thereof are omitted. An end S1*a* of the wire S1 and an end S3*b* of the wire S3 are led out from the winding core 3 and connected to the corresponding terminal electrodes 6*a* and 6*c*, respectively, without crossing the other wires. On the other hand, an end S2*b* of the wire S2 and an end S4*a* of the wire S4 are each led out from a side surface side of the winding core 3 which is a far side from the terminal electrode to which each of the wires S2 and S4 should be connected so as to cross a center axis Y0 of the winding core 3 and connected to the corresponding terminal electrode. Specifically, the wire S2 is led out from a left side surface 3*b* of the winding core 3 so as to cross the center axis Y0 and connected to the terminal electrode 6*b*. The wire S3 is led out from a right side surface 3*a* of the winding core 3 so as to cross the center axis Y0 and connected to the terminal electrode 6*c*. Thus, wires S2 and S3 are connected to the corresponding terminal electrodes 6*b* and 6*c*, respectively, after crossing each other.

However, the above-described conventional pulse transformer has a problem in that the lead section of one wire that crosses the other may also contact a different terminal electrode from its connection target terminal electrode. That is, the wire S4 that crosses the wire S2 at the flange 4A side may contact the terminal electrode 6*b* in the course of connecting the end S4*a* to the terminal electrode 6*c*, and the wire S1 that crosses the wire S3 at the flange 4B side may contact the terminal electrode 6*e* in the course of connecting the end S1*a* to the terminal electrode 6*f*. To avoid such contact, it is necessary to bend the end portion sharply for connection to the corresponding terminal electrode, making it very difficult to handle the wires with an automatic winding machine.

SUMMARY

An object of the present invention is therefore to provide a pulse transformer capable of preventing the lead section of the wire from contacting a different terminal electrode from its connection terminal electrode and thus achieving high connection reliability.

To solve the above problem, a pulse transformer according to an aspect of the present invention includes a drum core having a winding core, a first flange provided at one end of the winding core in a first direction, and a second flange provided at the other end of the winding core in the first direction; a first terminal electrode, a second terminal electrode, and a second center tap which are provided on a bottom surface of the first flange and arranged in a second direction perpendicular to the first direction; a third terminal electrode, a fourth terminal electrode, and a first center tap which are provided on a bottom surface of the second flange and arranged in the second direction; a first wire wound around the winding core and having one end connected to the first terminal electrode and the other end connected to the first center tap; a second wire wound around the winding core and having one end connected to the first center tap and the other end connected to the second terminal electrode; a third wire wound around the winding core and having one end connected to the fourth terminal electrode and the other end connected to the second center tap; and a fourth wire wound around the winding core and having one end connected to the second center tap and the other end connected to the third terminal electrode, wherein a front end of the second terminal electrode positioned near an inner side surface of the first flange is set back toward an outer side surface of the first flange, and a front end of the fourth terminal electrode positioned near an inner side surface of the second flange is set back toward an outer side surface of the second flange.

According to the present invention, it is possible to avoid a lead section of the fourth wire from contacting the second terminal electrode which is a different electrode from its connection electrode (second center tap) and to avoid a lead section of the first wire from contacting the fourth terminal electrode which is a different electrode from its connection electrode (first center tap). This allows a pulse transformer having high connection reliability to be provided and allows facilitation of lead-out of the wire and connection of the wire to the terminal electrode.

It is preferable in the present invention that the first and fourth wires are wound in a first winding direction from the one end of the winding core to the other end thereof, the second and third wires are wound in a second winding direction opposite to the first winding direction from the one end of the winding core to the other end thereof, and at least one lead section of the first and fourth wires crosses at least one lead section of the second and third wires. In this case, it is particularly preferable that a position at which at least one lead section of the first and fourth wires crosses at least one lead section of the second and third wires exists on the bottom surface of the first or second flange. With this configuration, it is possible to easily wind the wire using an automatic winding machine.

It is preferable in the present invention that the front end of the first terminal electrode is positioned closer to the inner side surface of the first flange than the front end of the second terminal electrode, and the front end of the third terminal electrode is positioned closer to the inner side surface of the second flange than the front end of the fourth terminal electrode. With this configuration, it is possible to facilitate connection of the one end of the first wire to the first terminal electrode while avoiding the lead section of the fourth wire from contacting the second terminal electrode. Similarly, it is possible to facilitate connection of the other end of the fourth wire to the third terminal electrode while avoiding the lead section of the first wire from contacting the fourth terminal electrode.

It is preferable in the present invention that the other end of the second wire is led out from a first side surface side of the winding core which is a far side from the second terminal electrode so as to cross a center axis of the winding core and connected to the second terminal electrode, the one end of the third wire is led out from a second side surface side of the winding core which is a far side from the third terminal electrode so as to cross the center axis of the winding core and connected to the third terminal electrode, the second and fourth wires cross each other in the course of connecting to the second terminal electrode and second center tap, respectively, and the third and first wires cross each other in the course of connecting to the fourth terminal electrode and first center tap, respectively. Although the above-described conventional problem is likely to occur in a winding structure in which wire lead sections cross each other, such a problem can be solved by the present invention.

It is preferable that a first distance between the second terminal electrode and second center tap in the second direction is larger than a second distance between the first terminal electrode and second terminal electrode in the second direction and, a third distance between the third terminal electrode and first center tap in the second direction is larger than a fourth distance between the third terminal electrode and fourth terminal electrode in the second direction.

It is preferable in the present invention that the second center tap includes a single terminal electrode provided on the first flange, and the first center tap includes a single terminal electrode provided on the second flange. This configuration can easily realize series connection of coils by connecting end portions of two wires onto the center tap having a single electrode.

It is preferable in the present invention that the front end of the first center tap is positioned closer to the inner side surface of the first flange than the front end of the second terminal electrode, and the front end of the second center tap is positioned closer to the inner side surface of the second flange than the front end of the fourth terminal electrode. With this configuration, it is possible to facilitate connection of end portions of two wires onto the center tap having a single electrode.

It is preferable in the present invention that the first center tap includes first and second center tap terminal electrodes provided on the second flange, the second center tap includes third and fourth center tap terminal electrodes provided on the first flange, the one end of the second wire is connected to the first center tap terminal electrode, the other end of the first wire is connected to the second center tap terminal electrode, the other end of the third wire is connected to the third center tap terminal electrode, the one end of the fourth wire is connected to the fourth center tap terminal electrode, a front end of the second center tap terminal electrode positioned near the inner side surface of the second flange is set back toward the outer side surface of the second flange, and a front end of the fourth terminal electrode positioned near the inner side surface of the first flange is set back toward the outer side surface of the first flange. With this configuration, in a pulse transformer of a four-terminal-pair structure, it is possible to avoid the wire lead section from contacting a different terminal fitting from its connection terminal electrode. This allows a pulse transformer having high connection reliability to be provided and allows facilitation of lead-out of the wire and connection of the wire to the terminal electrode.

It is preferable in the present invention that the first center tap includes first and second center tap regions provided in a single terminal electrode, that the second center tap includes third and fourth center tap regions provided in a single terminal electrode, the one end of the second wire is connected to the first center tap region, the other end of the first wire is connected to the second center tap region, the other end of the third wire is connected to the third center tap region, the one end of the fourth wire is connected to the fourth center tap region, a front end of the second center tap region positioned near the inner side surface of the second flange is set back toward the outer side surface of the second flange, and a front end of the third center tap region positioned near the inner side surface of the first flange is set back toward the outer side surface of the first flange. With this configuration, in a pulse transformer of a three-terminal-pair structure in which the center tap is formed as a wide terminal electrode, it is possible to avoid the wire lead section from contacting a different terminal fitting from its connection terminal electrode.

It is preferable in the present invention that the first to fourth terminal electrodes and first and second center taps are each formed as a terminal fitting fixed to the first or second flange. The use of the terminal fitting as the terminal electrode is advantageous over the use of a plating electrode in easiness of forming thereof and is thus also advantageous in manufacturing cost. Further, attachment position accuracy of the terminal fitting can be enhanced.

It is preferable in the present invention that the first to fourth terminal electrodes and first and second center taps are each formed of a conductive material directly applied on the first or second flange. This allows formation of a more elaborate and robust electrode surface having high fixing strength with respect to a material, thereby enhancing erosion resistance and shock resistance.

As described above, the use of the pulse transformer according to the present invention makes it possible to avoid the wire lead section from contacting a different terminal fitting from its connection target terminal electrode. Thus, it is possible to provide a pulse transformer having high connection reliability and allowing facilitation of lead-out of the wire and connection of the wire to the terminal electrode.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

Figure 1:
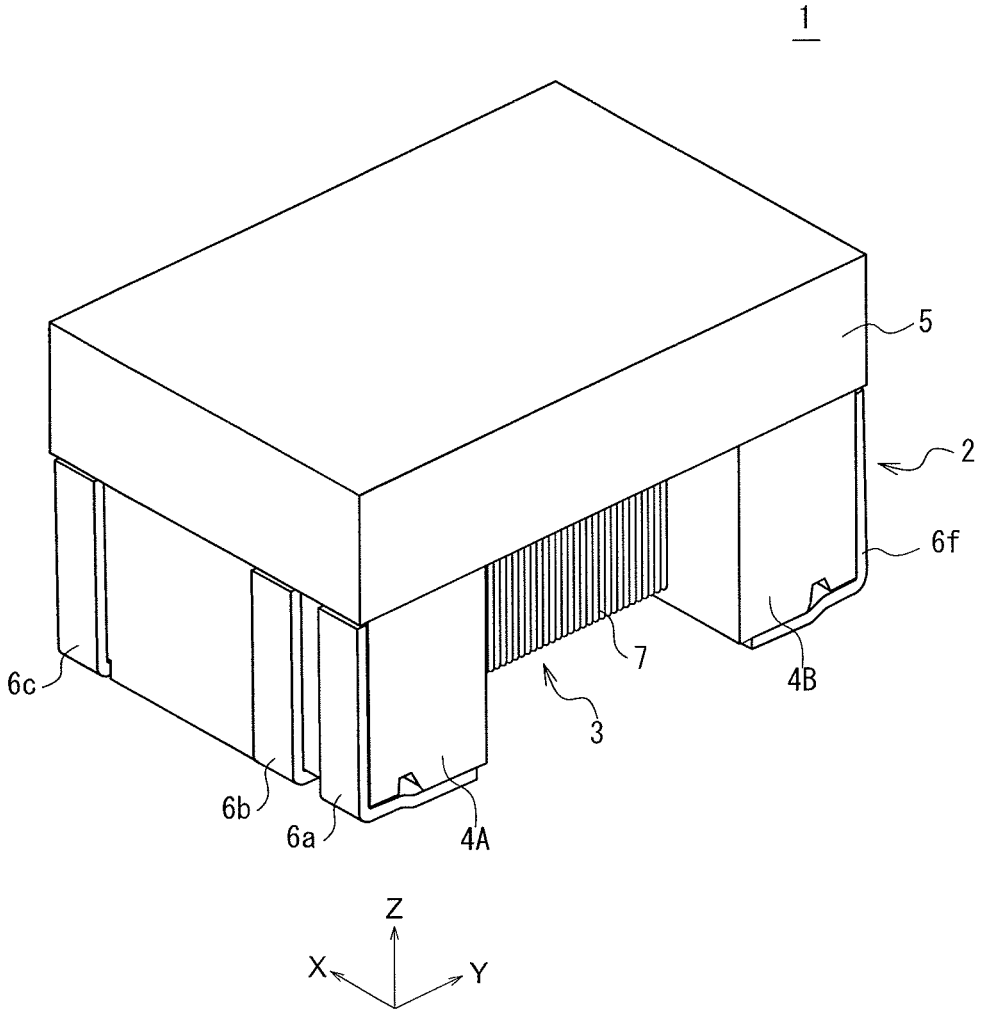
FIG. 1 is a schematic perspective view illustrating an outer appearance of a pulse transformer 1 according to a first embodiment of the present invention.
Figure 2:
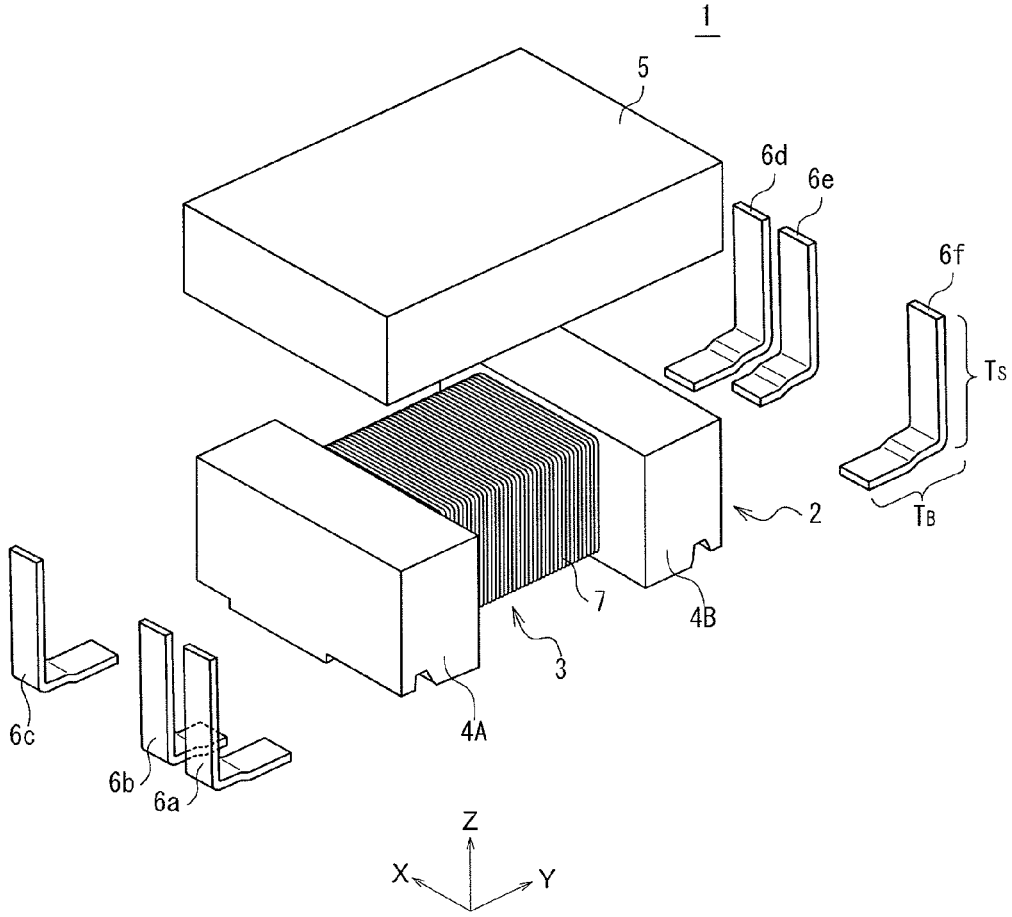
FIG. 2 is an exploded perspective view of the pulse transformer 1 according to the present embodiment.

FIG. 1 is a schematic perspective view illustrating an outer appearance of a pulse transformer 1 according to a first embodiment of the present invention. FIG. 2 is an exploded perspective view of the pulse transformer 1 according to the present embodiment, and FIG. 3 is a schematic perspective view of the pulse transformer 1 set with the top and bottom thereof reversed and viewed from the bottom side.

Figure 3:
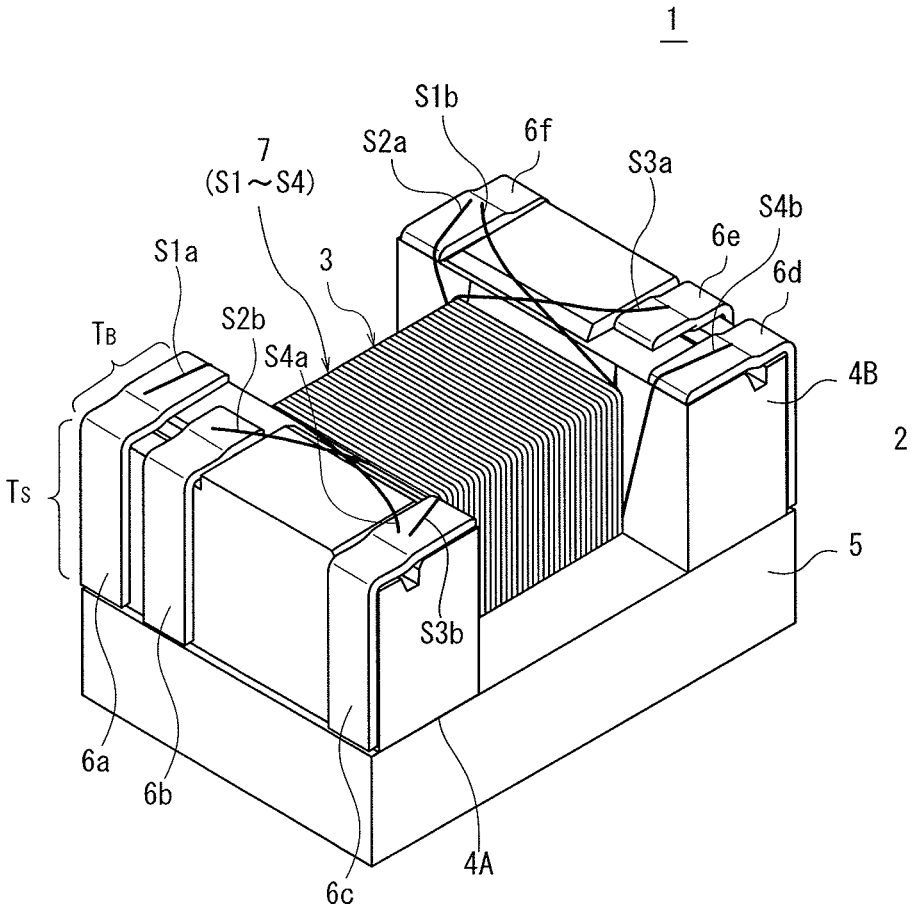
FIG. 3 is a schematic perspective view of the pulse transformer 1 set with the top and bottom thereof reversed and viewed from the bottom side.

As illustrated in FIGS. 1 to 3, the pulse transformer 1 according to the present embodiment includes a drum core 2, a plate core 5, six terminal fittings 6*a* to 6*f*, and a coil 7 having wires wound around the drum core 2. Although not especially limited, the pulse transformer 1 has a size of about 4.5 mm (X-direction)×about 3.2 mm (Y-direction)×about 2.9 mm (Z-direction).

The drum core 2 is formed of a magnetic material such as an Ni—Zn-based ferrite and includes a winding core 3 around which the coil 7 is wound and a pair of flanges 4A and 4B disposed at both ends of the winding core 3 in the Y-direction. The plate core 5 is also formed of a magnetic material such as Ni—Zn-based ferrite and placed and fixed by adhesive onto upper surfaces of the flanges 4A and 4B.

An upper surface of the plate core 5 is a flat smooth surface, and thus mounting of the pulse transformer 1 can be achieved using the flat smooth surface as an absorption surface. Preferably, a surface of the plate core 5 to be adhered to upper surfaces of the respective flanges 4A and 4B is also a flat smooth surface. Abutment of the flat smooth surface of the plate core 5 against the flanges 4A and 4B allows tight adhesion between the plate core 5 and flanges 4A, 4B, thereby forming a closed magnetic path free from magnetic flux leakage.

Each of the terminal fittings 6*a* to 6*f* are an L-shaped metal piece extending from a bottom surface of the flange 4A or 4B to an outside side surface thereof. The outside side surface of the flange refers to a surface positioned at an opposite side to a coupling surface of the winding core 3. Preferably, the terminal fittings 6*a* to 6*f* are parts cut out from a lead frame obtained from a single metal piece. The terminal fittings 6*a* to 6*f* are adhered and fixed to the drum core 2 in a state before being cut out from the lead frame and then cut out from a frame part of the lead frame, whereby independent terminal fittings are obtained. The use of the terminal fittings 6*a* to 6*f* is advantageous over the use of a plating electrode in easiness of forming thereof and is thus also advantageous in manufacturing cost. Further, attachment position accuracy of the terminal fittings 6*a* to 6*f* can be enhanced.

Of six terminal fittings 6*a* to 6*f*, three terminal fittings 6*a*, 6*b*, and 6*c* are provided on the flange 4A side, and remaining three terminal fittings 6*d*, 6*e*, and 6*f* are provided on the flange 4B side. The terminal fittings 6*a*, 6*b*, and 6*c* are arranged in the X-direction on the flange 4A, and the terminal fittings 6*d*, 6*e*, and 6*f* are arranged in the X-direction on the flange 4B.

Of three terminal fittings 6*a*, 6*b*, and 6*c*, two terminal fittings 6*a* and 6*b* are provided near one end (in FIG. 2, near a right end) of the flange 4A in the X-direction, and one terminal fitting 6*c* is provided near the other end (in FIG. 2, near a left end) of the flange 4A in the X-direction. That is, a distance between the terminal fittings 6*b* and 6*c* is larger than a distance between the terminal fittings 6*a* and 6*b*, thereby ensuring withstand voltage between the primary and secondary sides. Similarly, of three terminal fittings 6*d*, 6*e*, and 6*f*, two terminal fittings 6*d* and 6*e* are provided near one end (in FIG. 2, near a left end) of the flange 4B in the X-direction, and one terminal fitting 6*f* is provided near the other end (in FIG. 2, near a right end) of the flange 4B in the X-direction. That is, a distance between the terminal fittings 6*e* and 6*f* is larger than a distance between the terminal fittings 6*d* and 6*e*, thereby ensuring withstand voltage between the primary and secondary sides.

As illustrated in FIG. 2, each of the L-shaped terminal fittings 6*a* to 6*f* have a bottom portion $T_B$ contacting the bottom surface of the flange 4A or 4B and a side portion $T_S$ contacting the outside side surface of the flange 4A or 4B. As illustrated in FIG. 3, each end of the coil 7 is thermal compression bonded to a corresponding surface of the bottom portion $T_B$ of the terminal fittings 6*a* to 6*f*.

The coil 7 has four wires S1 to S4. The wires S1 to S4 are coated wires and wound around the winding core 3 in a two-layer structure. More in detail, the wires S1 and S4 are wound by bifilar winding to constitute a first layer, and the wires S2 and S3 are wound by bifilar winding to constitute a second layer. The wires S1 to S4 have the same number of turns.

The first layer (wires S1 and S4) and second layer (wires S2 and S3) have different winding directions. That is, when the winding direction, e.g., from the flange 4A toward the flange 4B is viewed from the flange 4A side, the winding direction of the wires S1 and S4 is clockwise (a first winding direction), while the winding direction of the wires S2 and S3 is counter clockwise (a second winding direction). This configuration is to avoid extending each wire from one end of the winding core 3 to the other end thereof at the start and end of winding.

Connection between the wires S1 to S4 and terminal fittings 6*a* to 6*f* will be described. One end S1*a* of the wire 51 and the other end S1*b* thereof are connected to the terminal fittings 6*a* and 6*f*, respectively, and one end S2*a* of the wire S2 and the other end S2*b* thereof are connected to the terminal fittings 6*f* and 6*b*, respectively. Further, one end S3*a* of the wire S3 and the other end S1*b* thereof are connected to the terminal fittings 6*e* and 6*c*, respectively, and one end S4*a* of the wire S4 and the other end S4*b* thereof are connected to the terminal fittings 6*c* and 6*d*, respectively.

Figure 4:
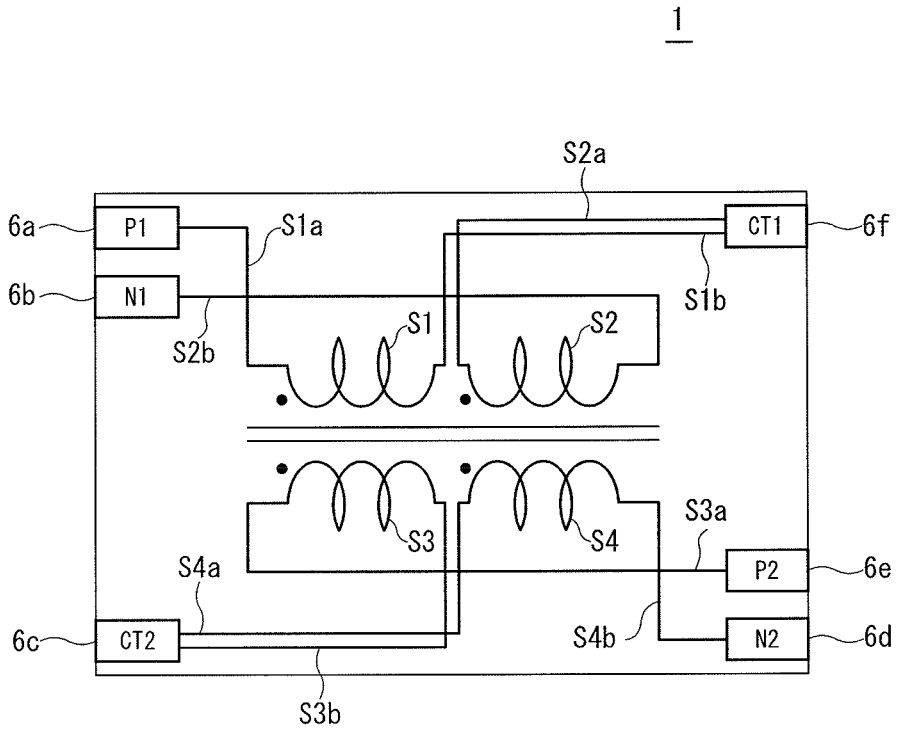
FIG. 4 is an equivalent circuit diagram of the pulse transformer 1.

FIG. 4 is an equivalent circuit diagram of the pulse transformer 1.

As illustrated in FIG. 4, the terminal fittings 6*a* and 6*b* are used as a pair of balanced inputs, that is, a primary-side positive-side terminal electrode P1 and a primary-side negative-side terminal electrode N1, respectively. The terminal fittings 6*e* and 6*d* are used as a pair of balanced outputs, that is, a secondary-side positive-side terminal electrode P2 and a secondary-side negative-side terminal electrode N2, respectively. The terminal fittings 6*f* and 6*c* are used as an input-side center tap CT1 and an output-side center tap CT2, respectively. The wires S1 and S2 constitute a primary winding of the pulse transformer, and the wires S3 and S4 constitute a secondary winding of the pulse transformer.

Figure 5:
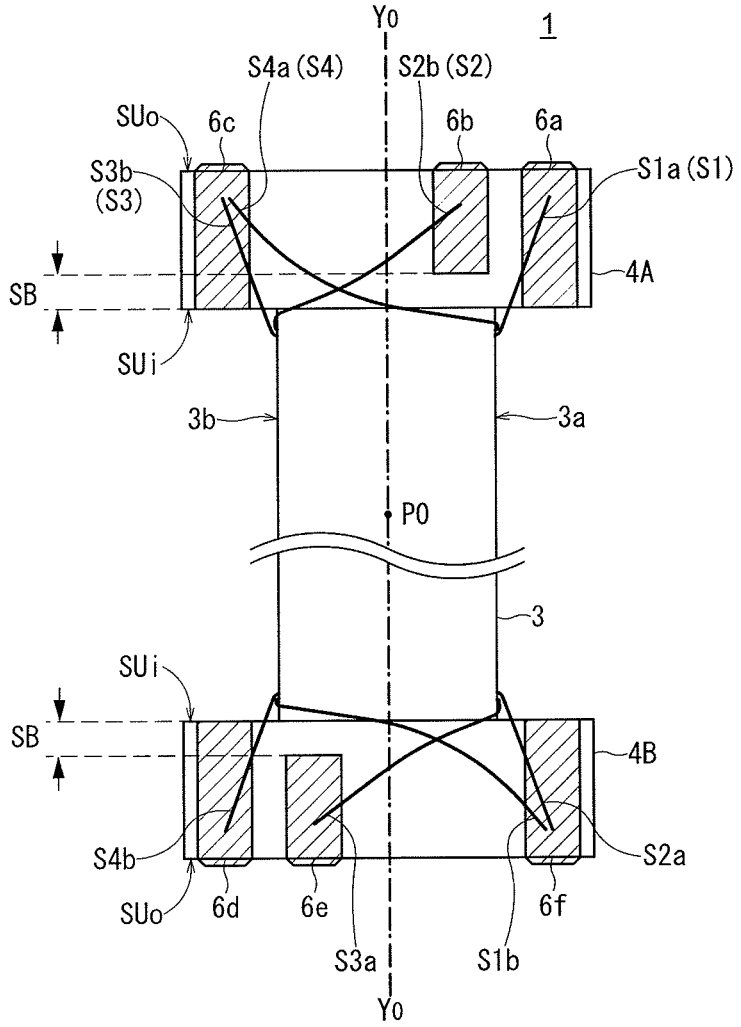
FIG. 5 is a schematic plan view illustrating a shape of a bottom portion of each terminal fitting provided on the flange.

FIG. 5 is a schematic plan view illustrating a shape of a bottom portion of each terminal fitting provided on the flange.

As illustrated in FIG. 5, of the terminal fittings 6*a*, 6*b*, and 6*c* at the flange 4A side, the terminal fittings 6*a* and 6*c* have a symmetrical positional relationship with respect to a center axis Y0 of the winding core 3 extending in the Y-direction, but a terminal fitting having a symmetrical positional relationship with the terminal fitting 6*b* is not provided. Similarly, of the terminal fittings 6*d*, 6*e*, and 6*f* at the flange 4B side, the terminal fittings 6*d* and 6*f* have a symmetrical positional relationship with respect to the center axis Y0, but a terminal fitting having a symmetrical positional relationship with the terminal fitting 6*e* is not provided. The drum core including the above terminal fittings is symmetrical about a gravity point P0, and terminal fittings 6*a*, 6*b*, and 6*c* have a rotationally symmetric relationship with the terminal fittings 6*d*, 6*e*, and 6*f*, respectively.

The one end S1*a* of the wire S1 and the other end S2*b* of the wire S2 are connected to the terminal fittings 6*a* and 6*b* at the flange 4A side, respectively, and the other end S1*b* of the wire S3 and one end S4*a* of the wire S4 are connected to the terminal fitting 6*c*.

The one end S1*a* of the wire S1 is led out from one side surface 3*a* side of the winding core 3 and connected to the terminal fitting 6*a*. The one end S4*a* of the wire S4 is led from the one side surface 3*a* side of the winding core 3 together with the one end S1*a* of the wire S1. The one end S4*a* then crosses the center axis Y0 of the winding core 3 and is connected to the terminal fitting 6*c*. On the other hand, the other end S3*b* of the wire S3 is led out from the other side surface 3*b* side (first side) of the winding core 3 and connected to the terminal fitting 6*c*. The other end S2*b* of the wire S2 is led from the other side surface 3*b* side of the winding core 3 together with the other end S3*b* of the wire S3. The other end S2*b* then crosses the center axis Y0 of the winding core 3 and is connected to the terminal fitting 6*b*.

As described above, the one end S1*a* of the wire S1 and the other end S3*b* of the wire S3 are each led out from a side surface side of the winding core 3 which is a near side from the terminal fitting to which each of the wires S1 and S3 is connected without crossing the center axis Y0 of the winding core 3 and connected to the corresponding terminal fitting. Thus, lead sections of the wires S1 and S3 at the flange 4A side does not cross the other wires in the course of connecting to the corresponding terminal fitting. On the other hand, the other end S2*b* of the wire S2 and one end S4*a* of the wire S4 are each led out from a side surface side of the winding core 3 which is a far side from the terminal fitting to which each of the wires S2 and S4 is connected so as to cross the center axis Y0 of the winding core 3 and connected to the corresponding terminal fitting. Thus, lead sections of the wires S2 and S4 at the flange 4A side cross each other in the course of connecting to the corresponding terminal fittings.

The other end S4*b* of the wire S4 and one end S3*a* of the wire S3 are connected to the terminal fittings 6*d* and 6*e* at the flange 4B side, respectively, and one end S2*a* of the wire S2 and the other end S1*b* of the wire S1 are connected to the terminal fitting 6*f*.

The other end S4*b* of the wire S4 is led out from the other side surface 3*b* side of the winding core 3 and connected to the terminal fitting 6*d*. The other end S1*b* of the wire S1 is led from the other side surface 3*b* side of the winding core 3 together with the other end S4*b* of the wire S4. The other end S1*b* then crosses the center axis Y0 of the winding core 3 and is connected to the terminal fitting 6*f*. On the other hand, one end S2*a* of the wire S2 is led out from one side surface 3*a* side (second side) of the winding core 3 and connected to the terminal fitting 6*f*. One end S3*a* of the wire S3 is led from the one side surface 3*a* side of the winding core 3 together with the one end S2*a* of the wire S2. The one end S3*a* then crosses the center axis Y0 of the winding core 3 and is connected to the terminal fitting 6*e*.

As described above, the one end S2*a* of the wire S2 and the other end S4*b* of the wire S4 are each led out from a side surface side of the winding core 3 which is a near side from the terminal fitting to which each of the wires S2 and S4 is connected without crossing the center axis Y0 of the winding core 3 and connected to the corresponding terminal fitting. Thus, lead sections of the wires S2 and S4 at the flange 4B side does not cross the other wires in the course of connecting to the corresponding terminal fitting. On the other hand, the other end S1*b* of the wire S1 and one end S3*a* of the wire S3 are each led out from a side surface side of the winding core 3 which is a far side from the terminal fitting to which each of the wires S1 and S3 is connected so as to cross the center axis Y0 of the winding core 3 and connected to the corresponding terminal fitting. Thus, lead sections of the wires S1 and S3 at the flange 4B side cross each other in the course of connecting to the corresponding terminal fittings.

In the present embodiment, on the bottom portions TB of the three terminal fittings 6*a*, 6*b*, and 6*c*, each front end of the two outside terminal fittings 6*a* and 6*c* with respect to the center axis Y0 reaches an inner side surface SUi of the flange 4A or near the inner side surface SUi, while a front end of the inside terminal fitting 6*b* with respect to the center axis Y0 is set back toward an outer side surface SUo of the flange 4A. The inner side surface SUi of the flange 4A refers to a surface on an opposite side to the outer side surface SUo and serves as a coupling surface of the winding core 3.

The lead sections of the wire S2 and S4 cross each other on the bottom surface of the flange 4A. Thus, if, for example, the terminal fitting 6*b* is not set back, the lead section of the wire S4 contacts a front end of the terminal fitting 6*b* in the course of connecting the one end S4*a* of the wire S4 to the terminal fitting 6*c* (see FIG. 12). It is possible to divert the route of the wire 4 so as to prevent the lead section of the wire S4 from contacting the front end of the terminal fitting 6*b*; in this case, however, the wire S4 needs to be bent sharply, thereby complicating handling of the wire end portion.

However, in the present embodiment, since the front end of the inside terminal fitting 6*b* is set back, it is possible to avoid the wire lead section from contacting a different terminal fitting from its connection terminal electrode. On the other hand, the terminal fittings 6*a* and 6*c* are not set back. Thus, each front end of the terminal fittings 6*a* and 6*c* reaches a position closer to the inner side surface of the flange 4A than the front end of the terminal fitting 6*b* is to the inner side surface. In particular, each front end of the terminal fittings 6*a* and 6*c* reaches an edge of the flange 4A at the inner side surface side or a position as close as possible to the edge of the flange 4A, making it possible to easily connect each end of the wires S1 and S4 to the corresponding terminal fitting. A setback amount SB of the front end of the terminal fitting 6*b* is not especially limited as long as it is possible to avoid the lead section of the wire S4 from contacting the terminal fitting 6*b* and to connect the wire S4 to its connection terminal fitting at its end portion.

Configurations of the terminal fittings 6*d*, 6*e*, and 6*f* at the flange 4B side are the same as those of the configurations of the terminal fittings 6*a*, 6*b*, and 6*c* at the flange 4A side. That is, a front end of the inside terminal fitting 6*e* is set back.

The pulse transformer 1 of a type in which three terminal fittings are fixed to each flange in the above embodiment; however, a configuration may be adopted in which four terminal fittings are fixed to each flange.

Figure 6:
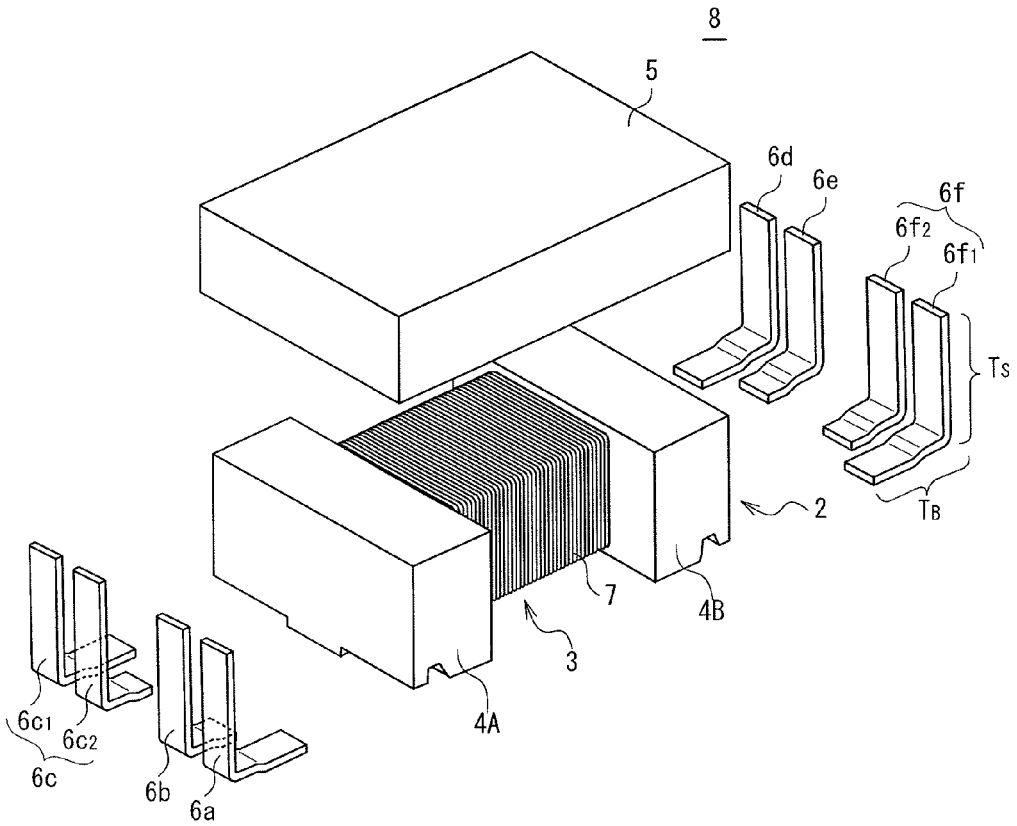
FIG. 6 is an exploded perspective view of a pulse transformer 8 according to a second embodiment of the present invention.
Figure 7:
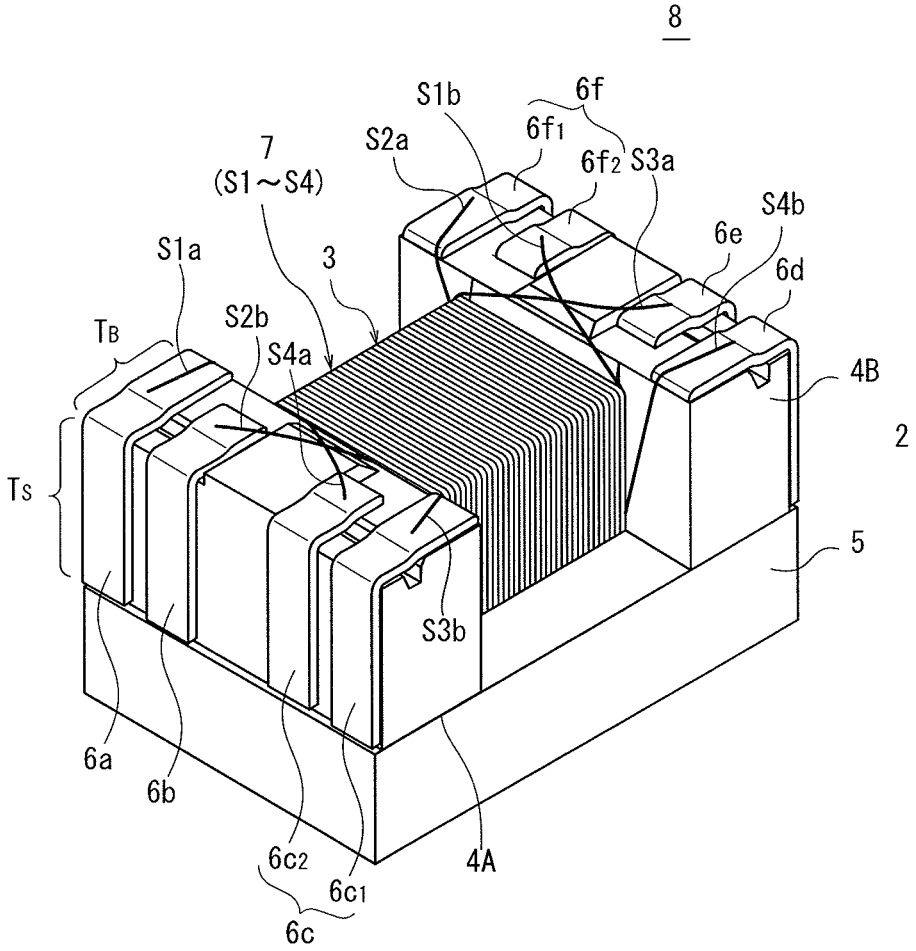
FIG. 7 is a schematic perspective view of the pulse transformer 8 set with the top and bottom thereof reversed and viewed from the bottom side.

FIG. 6 is an exploded perspective view of a pulse transformer 8 according to a second embodiment of the present invention, and FIG. 7 is a schematic perspective view of the pulse transformer 8 set with the top and bottom thereof reversed and viewed from the bottom side.

As illustrated in FIGS. 6 and 7, the terminal fitting 6*c* is divided into two terminal fittings 6*c*1 and 6*c*2, and terminal fitting 6*f* is divided into two center tap terminal fittings 6*f*1 and 6*f*2. That is, four terminal fittings are fixed to each of the pair of flanges 4A and 4B. In this case, the other end S3*b* of the wire S3 is connected to the terminal fitting 6*c*1 (or 6*c*2), the one end S4*a* of the wire S4 is connected to the terminal fitting 6*c*2 (or 6*c*1), one end S2*a* of the wire S2 is connected to the terminal fitting 6*f*1 (or 6*f*2), and the other end S1*b* of the wire S1 is connected to the terminal fitting 6*f*2 (or 6*f*1). Then, the terminal fittings 6*f*1 and 6*f*2 are short-circuited to each other through a wiring pattern (land) on a printed circuit board, and the terminal fittings 6*c*1 and 6*c*2 are short-circuited to each other through the wiring pattern (land) on the printed circuit board, whereby substantially the same function as that obtained by the pulse transformers 1 illustrated in FIGS. 1 to 3 can be achieved.

Figure 8:
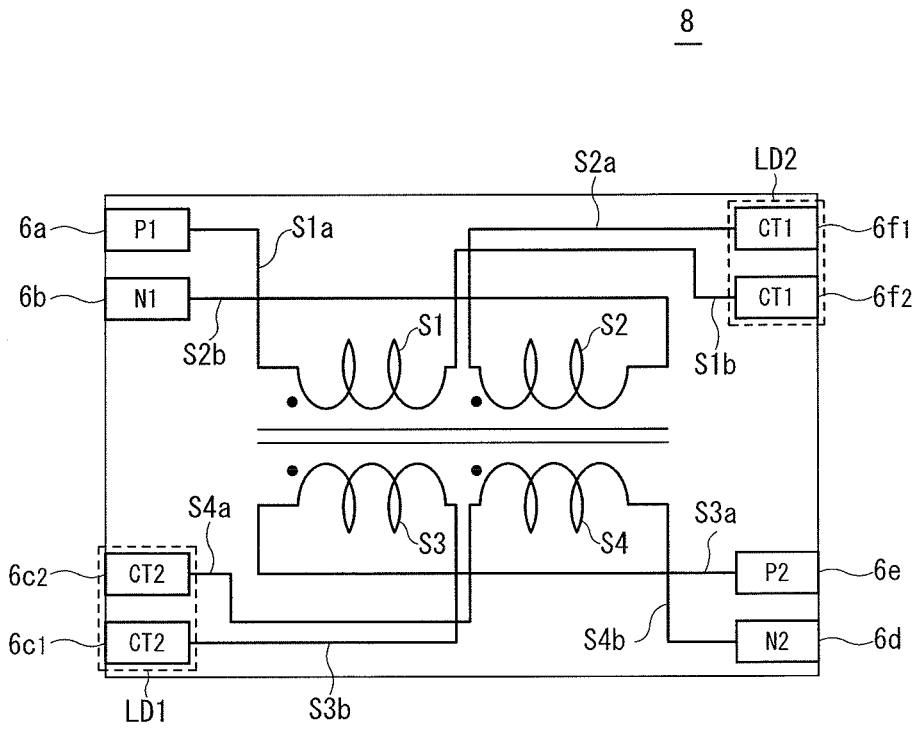
FIG. 8 is an equivalent circuit diagram of the pulse transformer 8.

FIG. 8 is an equivalent circuit diagram of the pulse transformer 8.

As illustrated in FIG. 8, the terminal fittings 6*a* and 6*b* are used as a pair of balanced inputs, that is, a primary-side positive terminal electrode P1 and a primary-side negative terminal electrode N1, respectively. The terminal fittings 6*e* and 6*d* are used as a pair of balanced outputs, that is, a secondary-side positive terminal electrode P2 and a secondary-side negative terminal electrode N2, respectively. The terminal fittings 6*c*1 and 6*c*2 are used as input-side center taps CT1 which are short-circuited to each other through a land LD1 on the mounting surface. The terminal fittings 6*f*1 and 6*f*2 are used as output-side center taps CT2 which are short-circuited to each other through a land LD2 on the mounting surface. The wires S1 and S2 constitute a primary winding of the pulse transformer, and the wires S3 and S4 constitute a secondary winding of the pulse transformer.

Figure 9:
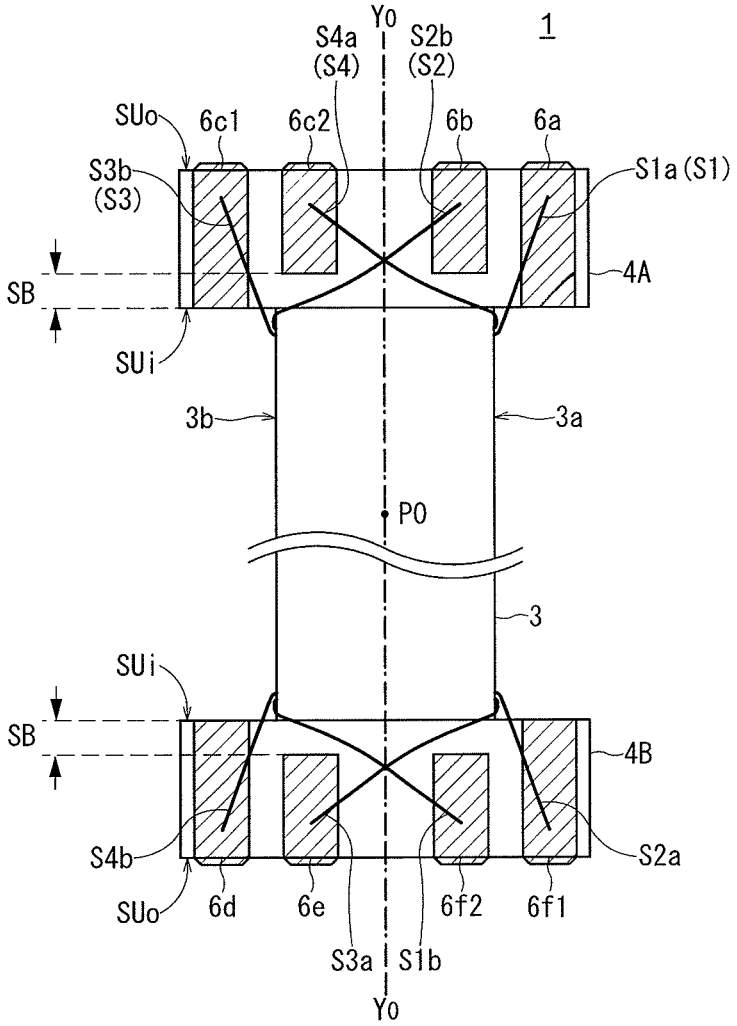
FIG. 9 is a schematic plan view illustrating a shape of the bottom portion of each terminal fitting provided on the flange.

FIG. 9 is a schematic plan view illustrating a shape of the bottom portion of each terminal fitting provided on the flange.

As illustrated in FIG. 9, of the four terminal fittings 6*a*, 6*b*, 6*c*1, and 6*c*2 at the flange 4A side, the terminal fittings 6*a* and 6*c*1 have a symmetrical positional relationship with respect to the center axis Y0 of the winding core 3 extending in the Y-direction, and the terminal fittings 6*b* and 6*c*2 have a symmetrical positional relationship with respect to the center axis Y0. Similarly, of the four terminal fittings 6*d*, 6*e*, 6*f*1, and 6*f*2 at the flange 4B side, the terminal fittings 6*d* and 6*f*1 have a symmetrical positional relationship with respect to the center axis Y0, and the terminal fittings 6*e* and 6*f*2 have a symmetrical positional relationship with respect to the center axis Y0. The drum core including the above terminal fittings is symmetrical about a gravity point P0, and terminal fittings 6*a*, 6*b*, 6*c*1, 6*c*2 have a rotationally symmetric relationship with the terminal fittings 6*d*, 6*e*, 6*f*1, and 6*f*2, respectively.

The one end S1*a* of the wire S1 and the other end S2*b* of the wire S2 are connected to the terminal fittings 6*a* and 6*b* at the flange 4A side, respectively, and the other end S3*b* of the wire S3 and one end S4*a* of the wire S4 are connected to the terminal fittings 6*c*1 and 6*c*2.

The one end S1*a* of the wire S1 is led out from one side surface 3*a* side of the winding core 3 and connected to the terminal fitting 6*a*. The one end S4*a* of the wire S4 is led from the one side surface 3*a* side of the winding core 3 together with the one end S1*a* of the wire S1. The one end S4*a* then crosses the center axis Y0 of the winding core 3 and is connected to the terminal fitting 6*c*2. On the other hand, the other end S3*b* of the wire S3 is led out from the other side surface 3*b* side of the winding core 3 and connected to the terminal fitting 6*c*1. The other end S2*b* of the wire S2 is led from the other side surface 3*b* side of the winding core 3 together with the other end S3*b* of the wire S3. The other end S2*b* then crosses the center axis Y0 of the winding core 3 and is connected to the terminal fitting 6*b*.

As described above, the one end S1*a* of the wire S1 and the other end S3*b* of the wire S3 are each led out from a side surface side of the winding core 3 which is a near side from the terminal fitting to which each of the wires S1 and S3 is connected without crossing the center axis Y0 of the winding core 3 and connected to the corresponding terminal fitting. Thus, lead sections of the wires S1 and S3 at the flange 4A side does not cross the other wires in the course of connecting to the corresponding terminal fitting. On the other hand, the other end S2*b* of the wire S2 and one end S4*a* of the wire S4 are each led out from a side surface side of the winding core 3 which is a far side from the terminal fitting to which each of the wires S2 and S4 is connected so as to cross the center axis Y0 of the winding core 3 and connected to the corresponding terminal fitting. Thus, lead sections of the wires S2 and S4 at the flange 4A side cross each other in the course of connecting to the corresponding terminal fittings.

The other end S4*b* of the wire S4 and one end S3*a* of the wire S3 are connected to the terminal fittings 6*d* and 6*e* at the flange 4B side, respectively, and one end S2*a* of the wire S2 and the other end S1*b* of the wire S1 are connected to the terminal fittings 6*f*1 and 6*f*2.

The other end S4*b* of the wire S4 is led out from the other side surface 3*b* side of the winding core 3 and connected to the terminal fitting 6*d*. The other end S1*b* of the wire S1 is led from the other side surface 3*b* side of the winding core 3 together with the other end S4*b* of the wire S4. The other end S1*b* then crosses the center axis Y0 of the winding core 3 and is connected to the terminal fitting 6*f*2. On the other hand, one end S2*a* of the wire S2 is led out from one side surface 3*a* side (second side) of the winding core 3 and connected to the terminal fitting 6*f*1. One end S3*a* of the wire S3 is led from the one side surface 3*a* side of the winding core 3 together with the one end S2*a* of the wire S2. The one end S3*a* then crosses the center axis Y0 of the winding core 3 and is connected to the terminal fitting 6*e*.

As described above, the one end S2*a* of the wire S2 and the other end S4*b* of the wire S4 are each led out from a side surface side of the winding core 3 which is a near side from the terminal fitting to which each of the wires S2 and S4 is connected without crossing the center axis Y0 of the winding core 3 and connected to the corresponding terminal fitting. Thus, lead sections of the wires S2 and S4 at the flange 4B side does not cross the other wires in the course of connecting to the corresponding terminal fitting. On the other hand, the other end S1*b* of the wire S1 and one end S3*a* of the wire S3 are each led out from a side surface side of the winding core 3 which is a far side from the terminal fitting to which each of the wires S1 and S3 is connected so as to cross the center axis Y0 of the winding core 3 and connected to the corresponding terminal fitting. Thus, lead sections of the wires S1 and S3 at the flange 4B side cross each other in the course of connecting to the corresponding terminal fittings.

In the present embodiment, on the bottom portions TB of the four terminal fittings 6*a*, 6*b*, 6*c*1, and 6*c*2, each front end of the two outside terminal fittings 6*a* and 6*c*1 reaches the inner side surface SUi of the flange 4A or near the inner side surface SUi, while each front end of the two inside terminal fittings 6*b* and 6*c*2 is set back toward the outer side surface SUo of the flange 4A.

The lead sections of the wire S2 and S4 cross each other on the bottom surface of the flange 4A. Thus, if, for example, the terminal fitting 6*b* is not set back, the lead section of the wire S4 contacts a front end of the terminal fitting 6*b* in the course of connecting the one end S4*a* of the wire S4 to the terminal fitting 6*c*2. Similarly, if the terminal fitting 6*c*2 is not set back, the lead section of the wire S2 contacts a front end of the terminal fitting 6*c*2 in the course of connecting the other end S2*a* of the wire S2 to the terminal fitting 6*b*. It is possible to divert each route of the wires S4 and S2 so as to prevent the lead sections of the respective wires S4 and S2 from contacting the front ends of the terminal fittings 6*b* and 6*c*2, respectively; in this case, however, the wires S4 and S2 need to be bent sharply, thereby complicating handling of the wire end portion.

However, in the present embodiment, since each front end of the inside two terminal fittings 6*b* and 6*c*2 is set back, it is possible to avoid the wire lead section from contacting a different terminal fitting from its connection terminal electrode. On the other hand, the terminal fittings 6*a* and 6*c*1 are not set back. Thus, each front end of the terminal fittings 6*a* and 6*c*1 reaches a position closer to the inner side surface of the flange 4A than each front end of the terminal fittings 6*b* and 6*c*2 is to the inner side surface. In particular, each front end of the terminal fittings 6*a* and 6*c*1 reaches an edge of the flange 4A at the inner side surface side or a position as close as possible to the edge of the flange 4A, making it possible to easily connect each end of the wires S1 and S4 to the corresponding terminal fittings. A setback amount SB of each front end of the terminal fitting 6*b* and 6*c*2 is not especially limited as long as it is larger than a setback amount of each front end of the terminal fitting 6*a* and 6*c*1 and it is possible to avoid lead sections of the respective wires S2 and S4 from contacting the terminal fitting 6*b* and 6*c*2 and to connect the wires S2 and S4 to their connection terminal fittings at their end portions.

Configurations of the terminal fittings 6*d*, 6*e*, 6*f*1, and 6*f*2 at the flange 4B side are the same as those of the configurations of the terminal fittings 6*a*, 6*b*, 6*c*1, and 6*c*2 at the flange 4A side. That is, each front end of the inside terminal fittings 6*e* and 6*f*2 is set back.

Figure 10:
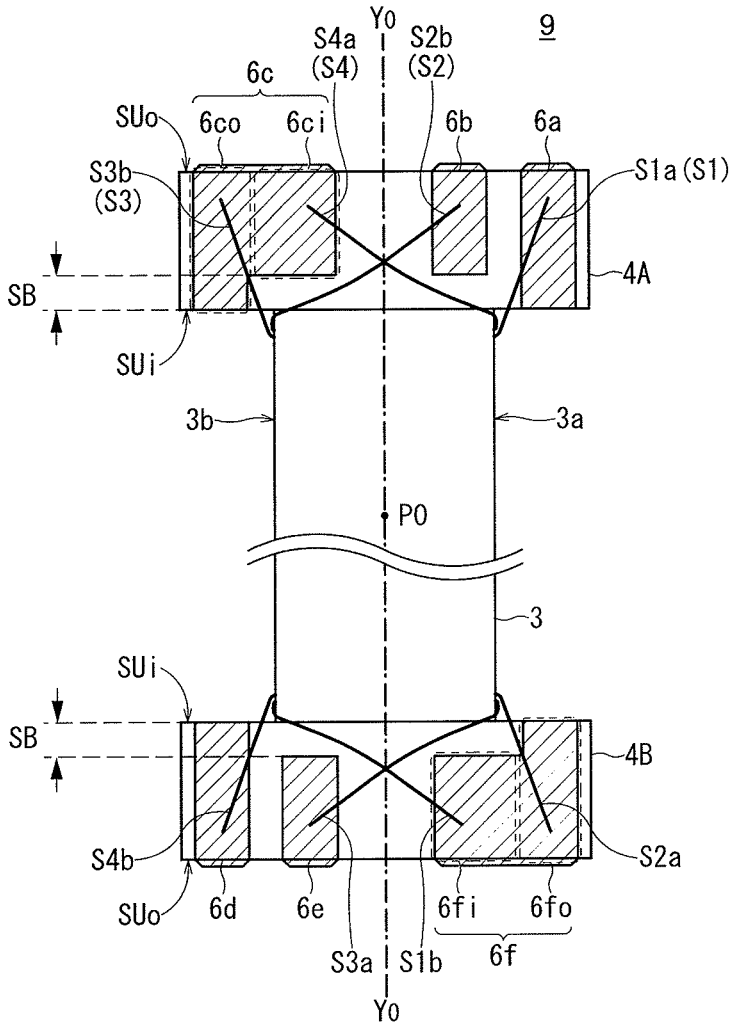
FIG. 10 is a schematic plan view illustrating a structure of a pulse transformer 9 according to a third embodiment of the present invention, and more specifically illustrating a shape of the bottom portion of each terminal fitting provided on the flange.

FIG. 10 is a schematic plan view illustrating a structure of a pulse transformer 9 according to a third embodiment of the present invention, and more specifically illustrating a shape of the bottom portion of each terminal fitting provided on the flange.

As illustrated in FIG. 10, a pulse transformer 9 according to the present embodiment uses, in place of the two terminal fittings 6*c*1 and 6*c*2 of the pulse transformer 8 illustrated in FIGS. 6 to 9, one large terminal fitting 6*c* that covers formation areas of the terminal fittings 6*c*1 and 6*c*2 and uses, in place of the two terminal fittings 6*f*1 and 6*f*2 of the pulse transformer 8, one large terminal fitting 6*f* that covers formation areas of the terminal fittings 6*f*1 and 6*f*2. In this case, the one end S4*a* of the wire S4 is connected to an inside area 6*ci* (or outside area 6*co*) of the terminal fitting 6*c*, and the other end S3*b* of the wire S3 is connected to an outside area 6*co* (or inside area 6*ci*) of the terminal fitting 6*c*. Further, the one end S2*a* of the wire S2 is connected to an outside area 6*fo* (or inside area 6*fi*) of the terminal fitting 6*f*, and the one end S2*a* of the wire S2 is connected to an inside area 6*fi* (or outside area 6*fo*) of the terminal fitting 6*f*.

In the present embodiment, of the bottom portions TB of the three terminal fittings 6*a*, 6*b*, and 6*c*, the front end of the terminal fitting 6*a* is not set back and reaches an edge of the flange 4A at the inner side surface side or a position near the edge of the flange 4A. On the other hand, the front end of the inside terminal fitting 6*b* is set back toward the outer side surface SUo of the flange 4A. As is the case with the terminal fitting 6*a*, the front end of the outside area 6*co* of the terminal fitting 6*c* reaches the edge of the flange 4A at the inner side surface side or a position near the edge of the flange 4A. On the other hand, the front end of the inside area 6*ci* is set back toward the outer side surface SUo of the flange 4A The lead sections of the wire S2 and S4 cross each other on the bottom surface of the flange 4A. Thus, if the inside area 6*ci* of the terminal fitting 6*c* is not set back, the lead section of the wire S2 contacts the front end of the inside area 6*ci* of the terminal fitting 6*c* in the course of connecting the other end S2*b* of the wire S2 to the terminal fitting 6*b*. It is possible to divert the route of the wire 2 so as to prevent the lead section of the wire S2 from contacting the front end of the inside area 6*ci* of the terminal fitting 6*c*; in this case, however, the wire S2 needs to be bent sharply, thereby complicating a winding process.

However, in the present invention, the front end of the inside area 6*ci* of the wide terminal fitting 6*c* is set back, so that it is possible to avoid the wire lead section from contacting a different terminal fitting from its connection target terminal electrode. On the other hand, the outside area 6*co* of the terminal fitting 6*c* is not set back. Thus, the front end of the outside area 6*co* of the terminal fitting 6*c* reaches a position as close as possible to the inner side surface of the flange 4A, making it possible to easily connect the end of the wire S4 to the corresponding terminal fitting. A setback amount SB of the front end of the inside area 6*ci* of the terminal fitting 6*c* is not especially limited as long as it is possible to avoid the lead section of the wire S2 from contacting the inside area 6*ci* of the terminal fitting 6*c* and to connect the wire S2 to its connection target terminal fitting at its end portion.

Configurations of the terminal fittings 6*d*, 6*e*, and 6*f* at the flange 4B side are the same as those of the configurations of the terminal fittings 6*a*, 6*b*, and 6*c* at the flange 4A side. That is, front ends of the terminal fitting 6*e* and inside area 6*fi* of the terminal fitting 6*f* are set back.

FIGS. 11A to 11D are schematic plan views illustrating modifications of a terminal electrode structure of the pulse transformer according to the present invention.

Figure 11A:
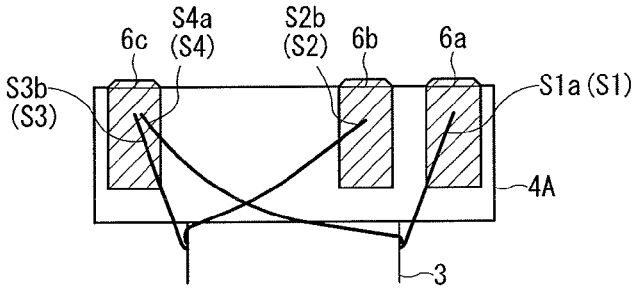
FIGS. 11A to 11D are schematic plan views illustrating modifications of a terminal electrode structure of the pulse transformer according to the present invention.
Figure 11B:
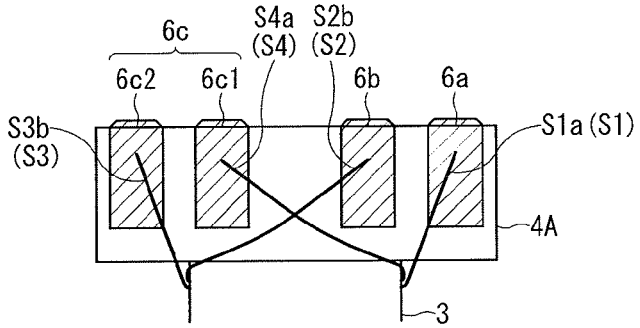
Figure 11C:
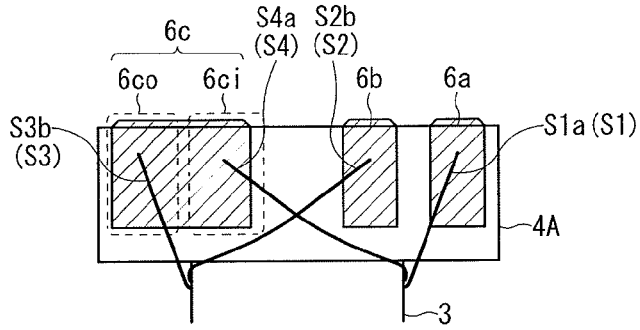

The terminal electrodes illustrated in FIGS. 11A to 11C each have a configuration in which each front end of all the terminal metal electrodes provided on the flange 4A are set back in a uniform way. The configuration of FIG. 11A is a modification of the pulse transformer 1 according to the first embodiment, in which the three terminal fittings 6*a*, 6*b*, and 6*c* are set back. The configuration of FIG. 11B is a modification of the pulse transformer 8 according to the second embodiment, in which the four terminal fittings 6*a*, 6*b*, 6*c*1, and 6*c*2 are set back. The configuration of FIG. 11C is a modification of the pulse transformer 9 according to the third embodiment, in which both the inside area 6*ci* and outside area 6*co* of the wide terminal fitting 6*c* are set back, and the front ends of the terminal fittings 6*a* and 6*b* are also set back.

Figure 11D:
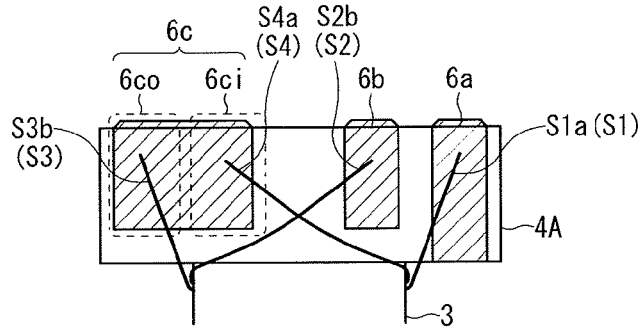

FIG. 11D is another modification of the pulse transformer 8 according to the third embodiment. As is the case with FIG. 11C, both the inside area 6*ci* and outside area 6*co* of the wide terminal fitting 6*c* are set back. Further, the front end of the terminal fitting 6*b* is set back, while the front end of the terminal fitting 6*a* is not set back.

As described above, all the electrode structures illustrated in FIGS. 11A to 11D have a configuration in which the front end of a terminal fitting that may contact a middle portion of the lead section of the wire S2 or wire S3 is set back, so that it is possible to avoid the wire lead section from contacting a different terminal fitting from its connection terminal electrode.

Figure 12:
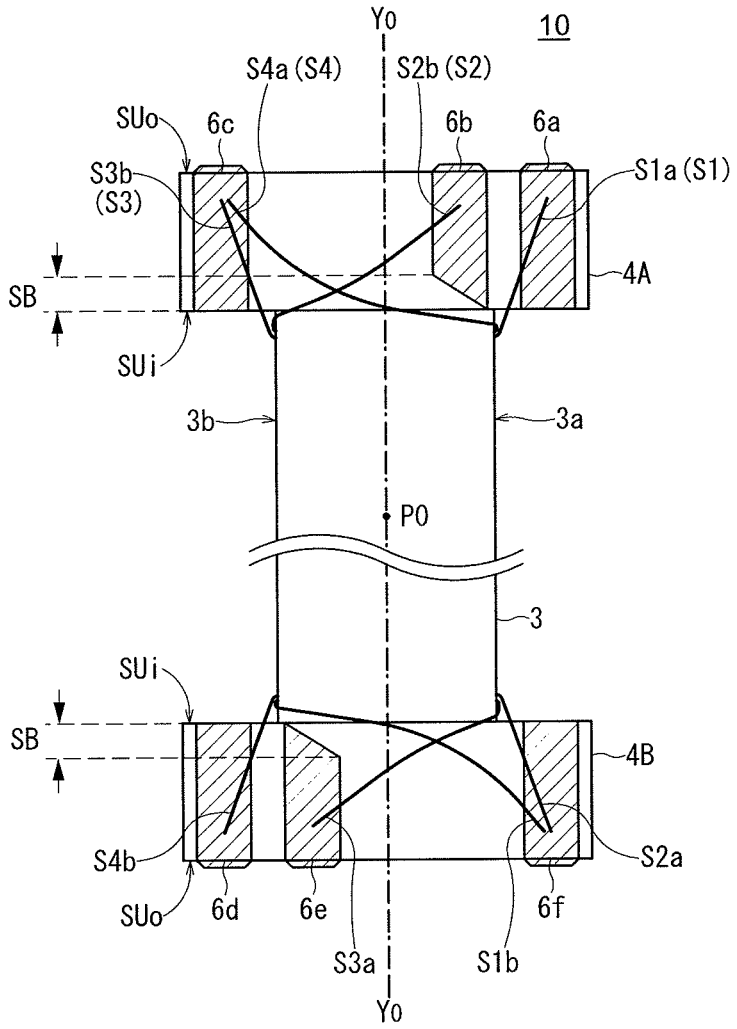
FIG. 12 is a schematic plan view illustrating another modification of the terminal electrode structure of the pulse transformer according to the present invention.
Figure 13:
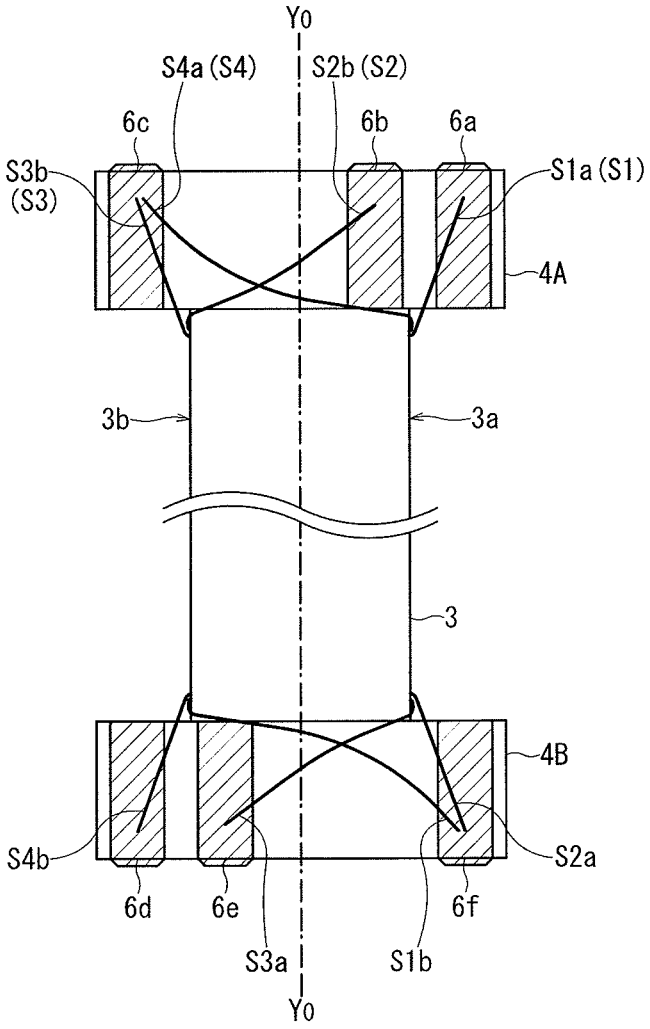
FIG. 13 is an exemplary plan view illustrating a terminal electrode structure of a conventional pulse transformer.

FIG. 12 is a schematic plan view illustrating another modification of the terminal electrode structure of the pulse transformer according to the present invention.

As illustrated in FIG. 12, in a pulse transformer 10, the front end of the terminal fitting 6*b* is not flat, but inclined in a direction approaching the outer side surface SUo of the flange 4A toward the center axis Y0 of the winding core 3, that is, gradually set back toward the outer side surface SUo. Similarly, the front end of the terminal fitting 6*e* is not flat, but inclined in a direction approaching the outer side surface SUo of the flange 4B toward the center axis Y0 of the winding core 3, that is, gradually set back toward the outer side surface SUo. Other configurations are the same as those of the pulse transformer 1 according to the first embodiment. With this configuration, the same effects as those in the first embodiment can be obtained.

Although the preferable embodiment of the invention has been described above, it is needless to say that the invention is by no means restricted to the embodiment and can be embodied in various modes within the scope which does not depart from the gist of the invention.

For example, although a pulse transformer of a type in which the terminal fittings are adhered to the flange is exemplified in the above embodiment, the pulse transformer of the present invention is not limited to this type, but may be a type in which a conductive material such as silver paste is directly formed on the flange. This allows formation of a more elaborate and robust electrode surface having high fixing strength with respect to a material, thereby enhancing erosion resistance and shock resistance.

What is claimed is:

1. A pulse transformer, comprising:

a drum core having a winding core, a first flange provided at one end of the winding core in a first direction, and a second flange provided at the other end of the winding core in the first direction;

a first terminal electrode, a second terminal electrode, and a second center tap which are provided on a bottom surface of the first flange and arranged in a second direction perpendicular to the first direction;

a third terminal electrode, a fourth terminal electrode, and a first center tap which are provided on a bottom surface of the second flange and arranged in the second direction;

a first wire wound around the winding core and having one end connected to the first terminal electrode and the other end connected to the first center tap;

a second wire wound around the winding core and having one end connected to the first center tap and the other end connected to the second terminal electrode;

a third wire wound around the winding core and having one end connected to the fourth terminal electrode and the other end connected to the second center tap; and a fourth wire wound around the winding core and having one end connected to the second center tap and the other end connected to the third terminal electrode, wherein a front end of the second terminal electrode positioned near an inner side surface of the first flange is set back toward an outer side surface of the first flange, a front end of the fourth terminal electrode positioned near an inner side surface of the second flange is set back toward an outer side surface of the second flange, a lead section of the second wire crosses at least one lead section of the first, third and fourth wires on the bottom surface of the first flange at a first cross point, a lead section of the third wire crosses at least one lead section of the first, second and fourth wires on the bottom surface of the second flange at a second cross point, the first cross point is positioned closer to the outer side surface of the first flange than a front end of the first terminal electrode and the second center tap, and the second cross point is positioned closer to the outer side surface of the second flange than a front end of the third terminal electrode and the first center tap.

2. The pulse transformer as claimed in claim 1, wherein the first and fourth wires are wound in a first winding direction from the one end of the winding core to the other end thereof, and the second and third wires are wound in a second winding direction opposite to the first winding direction from the one end of the winding core to the other end thereof.

3. The pulse transformer as claimed in claim 1, wherein the front end of the first terminal electrode is positioned closer to the inner side surface of the first flange than the front end of the second terminal electrode, and the front end of the third terminal electrode is positioned closer to the inner side surface of the second flange than the front end of the fourth terminal electrode.

4. The pulse transformer as claimed in claim 1, wherein the other end of the second wire is led out from a first side surface side of the winding core which is a far side from the second terminal electrode so as to cross a center axis of the winding core and connected to the second terminal electrode, the one end of the third wire is led out from a second side surface side of the winding core which is a far side from the third terminal electrode so as to cross the center axis of the winding core and connected to the fourth terminal electrode, the second and fourth wires cross each other at the first cross point in the course of connecting to the second terminal electrode and second center tap, respectively, and the third and first wires cross each other at the second cross point in the course of connecting to the fourth terminal electrode and first center tap, respectively.

5. The pulse transformer as claimed in claim 1, wherein a first distance between the second terminal electrode and second center tap in the second direction is larger than a second distance between the first terminal electrode and second terminal electrode in the second direction and, a third distance between the fourth terminal electrode and first center tap in the second direction is larger than a third distance between the third terminal electrode and fourth terminal electrode in the second direction.

6. The pulse transformer as claimed in claim 1, wherein the second center tap comprises a single terminal electrode provided on the first flange, and the first center tap comprises a single terminal electrode provided on the second flange.

7. The pulse transformer as claimed in claim 6, wherein the front end of the first center tap is positioned closer to the inner side surface of the first flange than the front end of the second terminal electrode, and the front end of the second center tap is positioned closer to the inner side surface of the second flange than the front end of the fourth terminal electrode.

8. The pulse transformer as claimed in claim 1, wherein the first center tap includes first and second center tap terminal electrodes provided on the second flange, the second center tap includes third and fourth center tap terminal electrodes provided on the first flange, the one end of the second wire is connected to the first center tap terminal electrode, the other end of the first wire is connected to the second center tap terminal electrode, the other end of the third wire is connected to the third center tap terminal electrode, the one end of the fourth wire is connected to the fourth center tap terminal electrode, a front end of one of the first and second center tap terminal electrodes positioned near the inner side surface of the second flange is set back toward the outer side surface of the second flange, and a front end of one of the third and fourth center tap terminal electrodes positioned near the inner side surface of the first flange is set back toward the outer side surface of the first flange.

9. The pulse transformer as claimed in claim 1, wherein the first center tap includes first and second center tap regions provided in a single terminal electrode, and the second center tap includes third and fourth center tap regions provided in a single terminal electrode, the one end of the second wire is connected to the first center tap region, the other end of the first wire is connected to the second center tap region, the other end of the third wire is connected to the third center tap region, the one end of the fourth wire is connected to the fourth center tap region, a front end of the second center tap region positioned near the inner side surface of the second flange is set back toward the outer side surface of the second flange, and a front end of the third center tap region positioned near the inner side surface of the first flange is set back toward the outer side surface of the first flange.

10. The pulse transformer as claimed in claim 1, wherein the first to fourth terminal electrodes and first and second center taps are each formed as a terminal fitting fixed to the first or second flange.

11. The pulse transformer as claimed in claim 1, wherein the first to fourth terminal electrodes and first and second center taps are each formed of a conductive material directly applied on the first or second flange.

12. A pulse transformer, comprising:

a drum core including a winding core, a first flange provided at one end of the winding core, and a second flange provided at other end of the winding core;

first, second, third and fourth terminal electrodes provided on the first flange;

fifth, sixth, seventh and eighth terminal electrodes provided on the second flange;

a first wire wound around the winding core so as to electrically connect the first and seventh terminal electrodes to each other;

a second wire wound around the winding core so as to electrically connect the second and eighth terminal electrodes to each other;

a third wire wound around the winding core so as to electrically connect the fourth and sixth terminal electrodes to each other; and a fourth wire wound around the winding core so as to electrically connect the third and fifth terminal electrodes to each other, wherein the second terminal electrode is located between the first and fourth terminal electrodes, the sixth terminal electrode is located between the fifth and eighth terminal electrodes, the first flange has a bottom surface on which the first, second, third and fourth terminal electrodes are provided, an inner side surface connected to the winding core, and an outer side surface opposite to the inner side surface, the second flange has a bottom surface on which the fifth, sixth, seventh and eighth terminal electrodes are provided, an inner side surface connected to the winding core, and an outer side surface opposite to the inner side surface, a front end of the second terminal electrode is set back toward the outer side surface of the first flange such that a front end of the first terminal electrode is positioned closer to the inner side surface of the first flange than the front end of the second terminal electrode, a front end of the sixth terminal electrode is set back toward the outer side surface of the second flange such that a front end of the fifth terminal electrode is positioned closer to the inner side surface of the second flange than the front end of the sixth terminal electrode, a lead section of the second wire crosses at least one lead section of the first, third and fourth wires on the bottom surface of the first flange at a first cross point, a lead section of the third wire crosses at least one lead section of the first, second and fourth wires on the bottom surface of the second flange at a second cross point, the first cross point is positioned closer to the outer side surface of the first flange than the front end of the first terminal electrode, and the second cross point is positioned closer to the outer side surface of the second flange than the front end of the fifth terminal electrode.

13. The pulse transformer as claimed in claim 12, wherein one of front ends of the third and fourth terminal electrodes is set back toward the outer side surface of the first flange, and one of front ends of the seventh and eighth terminal electrodes is set back toward the outer side surface of the second flange.

14. The pulse transformer as claimed in claim 13, wherein other of front ends of the third and fourth terminal electrodes is positioned closer to the inner side surface of the first flange than the one of front ends of the third and fourth terminal electrodes, and other of front ends of the seventh and eighth terminal electrodes is positioned closer to the inner side surface of the second flange than the one of front ends of the seventh and eighth terminal electrodes.

15. The pulse transformer as claimed in claim 12, wherein the first and fourth wires are wound in a first winding direction from the one end of the winding core to the other end thereof, and the second and third wires are wound in a second winding direction opposite to the first winding direction from the one end of the winding core to the other end thereof.

16. A pulse transformer, comprising:

a drum core including a winding core, a first flange provided at one end of the winding core, and a second flange provided at other end of the winding core;

first, second, third and fourth terminal electrodes provided in this order on the first flange;

fifth, sixth, seventh and eighth terminal electrodes provided in this order on the second flange; and first, second, third and fourth wires each electrically connects different one of the first, second, third and fourth terminal electrodes to different one of the fifth, sixth, seventh and eighth terminal electrodes to each other, wherein the first flange has a bottom surface on which the first, second, third and fourth terminal electrodes are provided, an inner side surface connected to the winding core, and an outer side surface opposite to the inner side surface, the second flange has a bottom surface on which the fifth, sixth, seventh and eighth terminal electrodes are provided, an inner side surface connected to the winding core, and an outer side surface opposite to the inner side surface, front ends of the second and third terminal electrodes are closer to the outer side surface of the first flange than front ends of the first and fourth terminal electrodes, front ends of the sixth and seventh terminal electrodes are closer to the outer side surface of the second flange than front ends of the fifth and eighth terminal electrodes, at least two lead sections of the first, second, third and fourth wires cross to each other on the bottom surface of the first flange at a first cross point and on the bottom surface of the second flange at a second cross point, the first cross point is positioned closer to the outer side surface of the first flange than the front ends of the first and fourth terminal electrodes, and the second cross point is positioned closer to the outer side surface of the second flange than the front ends of the fifth and eighth terminal electrodes.

17. The pulse transformer as claimed in claim 16, wherein the first and second wires are electrically connected to the first and second terminal electrodes, respectively, and the first and second wires are wound in a different winding direction from each other.

18. The pulse transformer as claimed in claim 17, wherein the third and fourth wires are electrically connected to the third and fourth terminal electrodes, respectively, and the third and fourth wires are wound in a different winding direction from each other.

19. The pulse transformer as claimed in claim 16, wherein a distance between the second and third terminal electrodes is greater than a distance between the first and second terminal electrodes.

20. The pulse transformer as claimed in claim 19, wherein the distance between the second and third terminal electrodes is greater than a distance between the third and fourth terminal electrodes.

21. The pulse transformer as claimed in claim 20, wherein a distance between the sixth and seventh terminal electrodes is greater than both of a distance between the fifth and sixth terminal electrodes and a distance between the seventh and eighth terminal electrodes.

22. The pulse transformer as claimed in claim 16, wherein the first to eighth terminal electrodes are each formed of a conductive material applied on the first or second flange.

* * * * *